US005175886A

United States Patent [19]

Suk

[11] Patent Number: 5,175,886

[45] Date of Patent: Jan. 5, 1993

[54] GOLF GLOVES

[76] Inventor: Young-Jing Suk, 98-25 Songpa-dong, Songpa-ku, Seoul 138-170, Rep. of Korea

[21] Appl. No.: 739,242

[22] Filed: Aug. 1, 1991

[30] Foreign Application Priority Data

Feb. 12, 1991 [KR] Rep. of Korea ..... 91-2135

[51] Int. Cl.[5] ..... A41D 19/00

[52] U.S. Cl. ..... 2/161 A; 2/169

[58] Field of Search ..... 2/163, 159, 161 A, 169, 2/161 R, 165

[56] References Cited

U.S. PATENT DOCUMENTS

| | | | |
|---|---|---|---|
| 206,567 | 7/1878 | Hesthal | 2/169 |
| 739,743 | 9/1903 | Thompson | 2/169 |
| 1,105,239 | 7/1914 | Baskin | 2/169 |
| 1,156,517 | 10/1915 | Baskin | 2/169 |
| 1,404,655 | 1/1922 | Scharman | 2/169 |
| 1,516,966 | 11/1924 | Jensen | 2/169 |
| 1,612,253 | 12/1926 | Bocci | 2/169 |
| 2,554,991 | 5/1951 | Kramer | 2/159 |
| 2,742,645 | 4/1956 | Bleeth | 2/169 |
| 4,068,317 | 1/1978 | Roeckl | 2/169 |

*Primary Examiner*—Werner H. Schroeder
*Assistant Examiner*—Sara M. Current
*Attorney, Agent, or Firm*—Foley & Lardner

[57] ABSTRACT

A golf glove provided with seams extending lengthwise from the middle of the ring and little fingers along the back portion of the glove provided with a groove on each of the back sections of the thumb and index finger with a flexible material so as to provide wearer comfort while at the same time unfolding to the original shape after they are taken off.

4 Claims, 3 Drawing Sheets

GOLF GLOVES

BACKGROUND OF THE INVENTION

1. Field of the Invention The present invention is directed to golf gloves that provide comfort to a golfer holding a golf club and that unfold to its original shape when taken off.

2. Description of Related Art

Conventional golf gloves have seams that run along the side of the little fingers. The knurls formed by the seams of the glove prove to be discomforting to golfer's hands when the golfer grabs a golf club.

SUMMARY OF THE INVENTION

The present invention overcomes the problems and disadvantages of the prior art by providing, in a cost effective manner, a novel golf glove that is comfortable to wear.

Additional objects and advantages of the invention will be set forth, in part, in the description which follows and, in part, will be obvious from the description or may be learned by practice of the invention. The objects and advantages of the invention may be learned by and attained by means of the instrumentalities and combination of steps particularly pointed out and set forth in the appending claims.

To achieve the foregoing objects and in accordance with the purpose of the present invention, as embodied and broadly described herein, the golf glove of the present invention is provided with seams on the back section extending lengthwise from the middle of the ring and the little fingers and provided with a groove on each back sections of the thumb and index finger which is covered from the inside of the thumb and index finger with a piece of man-made fabric known as spandex such as the type sold under the trade name LYCRA. by sewing around the grooves so as to provide the wearer comfort and relieve him or her from anxiety about a possible tearing of the seams along both sides of the little fingers.

The accompanying drawings, which are incorporated in and constitute a part of this specification, illustrate specific embodiments of the invention and, together, with the description, serve to explain the principles of the invention.

DETAILED DESCRIPTION OF THE PREFERRED EMBODIMENTS

Figure 1:
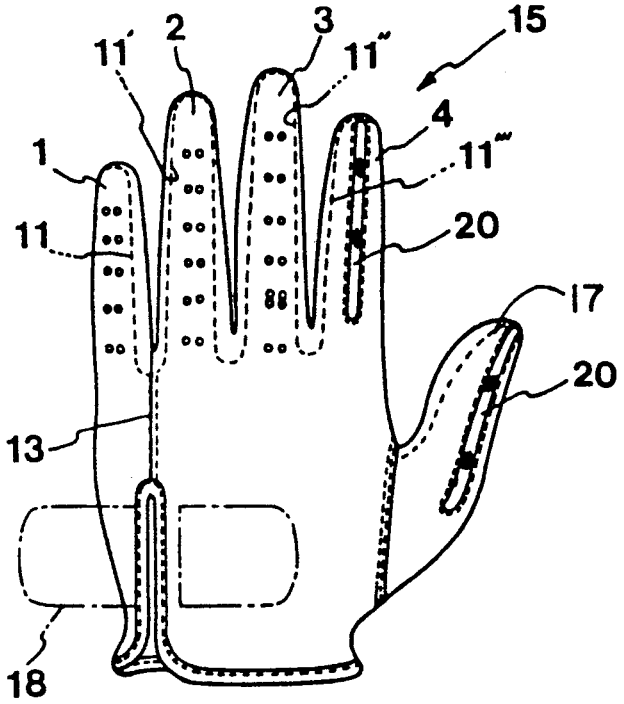
FIG. 1 is a rear, elevational view of the back section of a golf glove provided with a seam extending lengthwise from the middle of the ring and little fingers and a groove on each of the thumb and index fingers.
Figure 2:
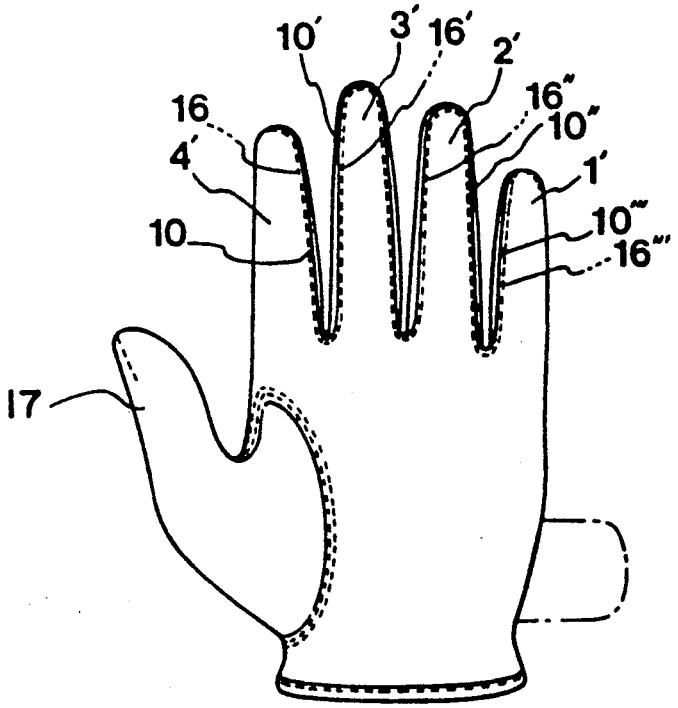
FIG. 2 is a front, elevational view of the front section of the golf glove shown in FIG. 1.

Reference will now be made, in detail, to a preferred embodiment of the present invention, an example of which is illustrated in the accompanying drawings and is represented generally by the numeral 15. Whenever possible, the same reference numbers will be used throughout the drawings to refer to the same or like parts.

Referring now to FIG. 3(A) and in accordance with the present invention, a golf glove is provided with a design having, in the order of from left to right, back sections of the ring finger 2, middle finger 3 and index finger 4 on which a groove 4'' runs lengthwise, and when the trank 19 is folded along the center line between the front and back sections of the index finger 4, 4', these back sections complement the front sections of the index finger 4', middle finger 3' ring finger 2', and the front and back sections of the little finger 1, 1' are provided at the end.

The glove is closed by stitching the back section 4 and the front section 4' with a fourchette 6 attached along the brims 5, 5'. The middle finger is closed by stitching the front and back sections 3,3' with a fourchette 6' being set in along the brims 7,7'; 7'', 7'''. The ring finger is closed by stitching the front and back sections 2, 2' along the brims 8, 8', 8'', 8''' with a fourchette 6'' being set in. The little finger is completed by stitching the front and back sections 1, 1'' with a fourchette being set in along the brims 9, 9'.

Each of the fingers is closed by stitching the fourchettes 6, 6', 6'', 6''' being set in the front sections 1, 1', 1'', 1''' of each finger from the outside so that brims 10, 10', 10'', 10''' are exposed to the outside.

Conversely, the back sections of each finger are closed by stitching the fourchettes 6, 6', 6'', 6''' being set in to the back sections 1, 2, 3, 4 of each finger from the inside by flipping over the trank so that the brims 11, 11', 11'', 11''' are not exposed to the outside.

Another feature of the present invention is to provide a groove 20 on the back sections of the thumb 17 and index finger 4. Each groove 20 is covered from the inside of the thumb 17 and index finger 4 with a piece of man-made fabric known as spandex 20 by sewing around the grooves 4'', 17'.

The trank 19 is closed by first sewing the left bream 12 and right bream 12' from the inside and then flipping the trank over and round up with the seam 13.

Figure 3:
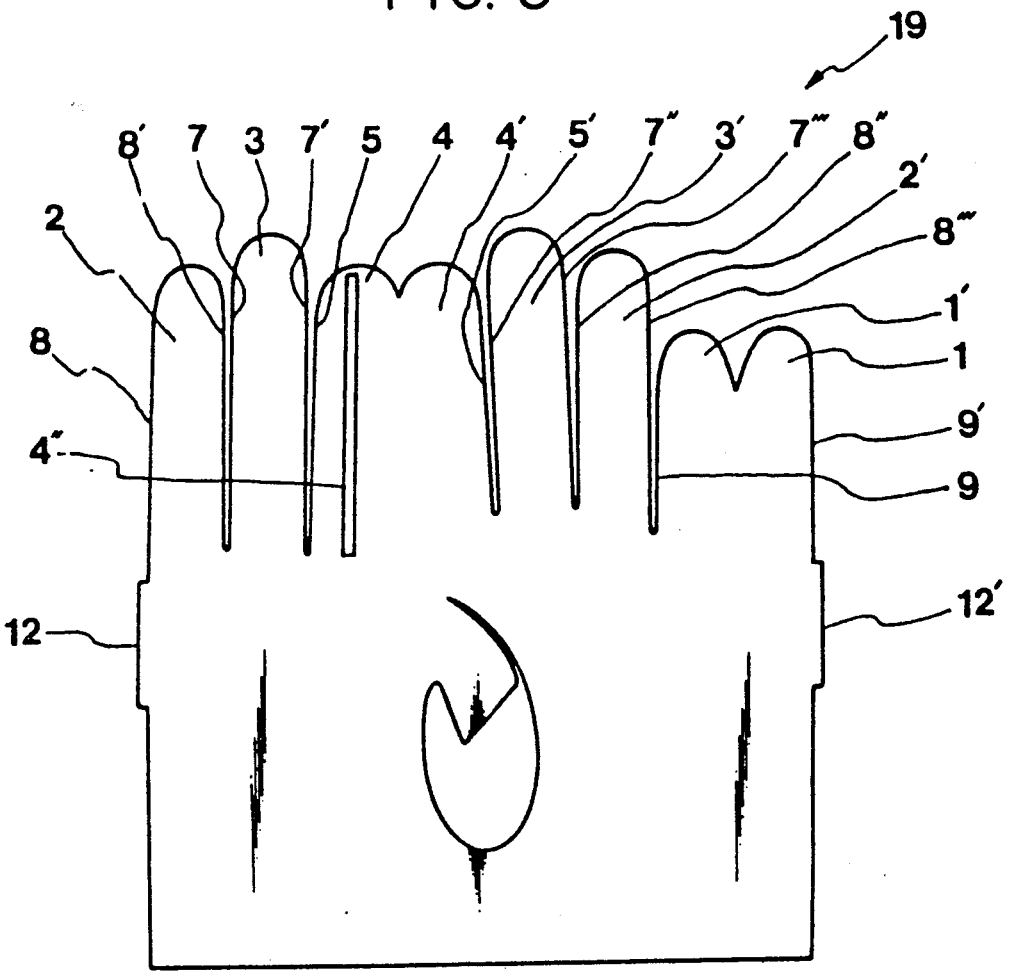
FIG. 3 is a plan view of the trank for one glove body.
Figure 4:
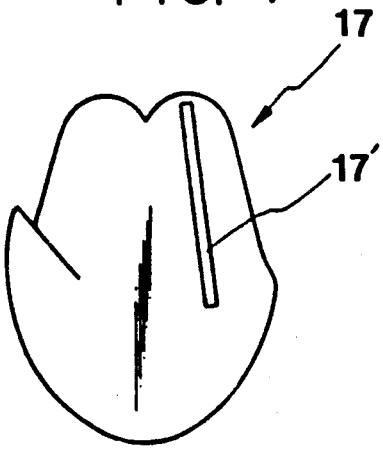
FIG. 4 is a is a plan view of a trank for a thumb of the glove body shown in FIG. 3.
Figure 5:
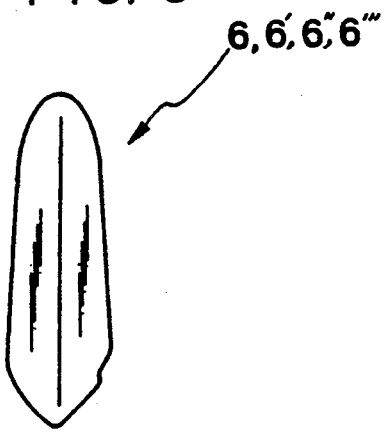
FIG. 5 is a plan view of a fourchette for the glove body shown in FIG. 3.
Figure 6:
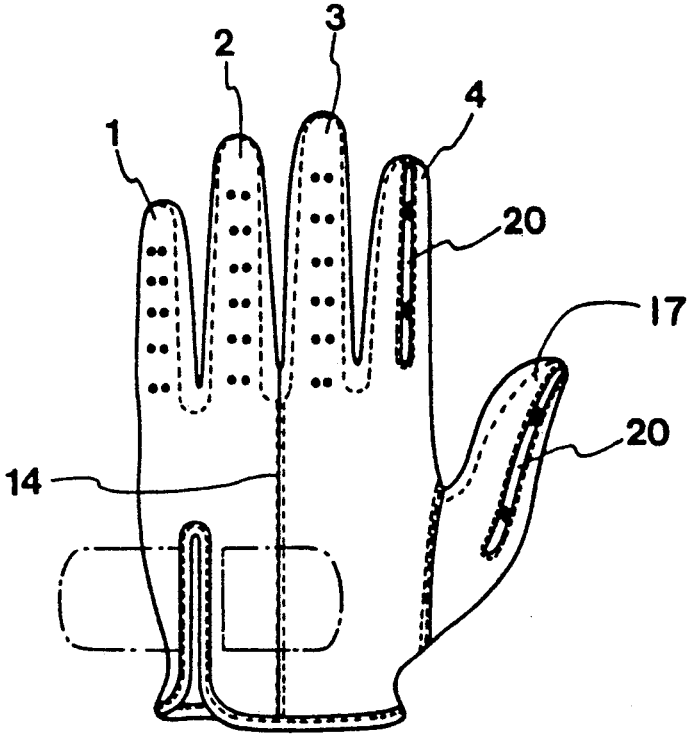
FIG. 6 is a front, elevational view of the back sections of a golf glove similar to the view shown in FIG. 1.

Another example of the present invention is illustrated in FIG. 3 wherein the trank is cut so that the back section of the ring finger 2 complements the back section of the little finger 1 and closes the trank according to the method already outlined so as to form a seam 14 as shown in FIG. 4.

The fourchettes 6, 6', 6'', 6''' are cut according to the size and shape corresponding to each finger and folded in one half.

The unexplained reference numeral 18 is a magnetic tape.

The preferred embodiment of the present invention is to provide one of the seams 13, 14 on the back section of a left hand glove so as to eliminate a seam on the side of the little finger from which unpleasant pressure is produced and by providing a groove on each of the back sections of the thumb and index finger which is covered from the inside with a piece of man-made fabric known as spandex by sewing around the grooves so as to provide the wearer comfort as well as to prevent the twisting of the fourchettes when golf is being played and to restore the glove to its original shape when it is taken off.

The feature of the present invention lies in the formation of a seam 13, 14 on the back sections of a glove instead of having it on the side of the little fingers so as to relieve pressure and prevent possible tear. As the size of the trank is made smaller it will contribute to the saving of the glove materials, less hours required for stitching, and a lowering of production costs.

It will be apparent to those skilled in the art that various modifications and variations can be made in the golf glove of the present invention without departing from the scope or spirit of the present invention. Thus, it is intended that the present invention cover the modifications and variations of this invention provided they come within the scope of the appended claims and their equivalents.

What is claimed is:

1. A golf glove comprising:

a single trank having front and back sections;

the front section having, respectively, an opening, for a thumb front sections for an index finger, a middle finger, a ring finger, a little finger, and a back section for the little finger;

the front section and back section for the little finger being continuous and folded along a first center line between the front section and back section for the little finger;

the back section having, respectively, back sections for the index finger, middle finger and ring finger, the back section for the index finger being provided with a groove that runs the length of the section for the index finger;

the front and back sections of the trank being continuous and folded along a second center line between the back section for the index finger and the front section for the index finger; and a thumb section integral to the trank at the opening, the thumb section having a front section and a back section, the front section and back section of the thumb section being continuous and folded along a third center line between the front section and the back section of the thumb section, the back section of the thumb section being provided with a groove that runs along the length of the thumb section;

each groove being covered and sewn from the inside of the glove with a flexible material.

2. The golf glove according to claim 1, wherein the flexible material is spandex.

3. A golf glove comprising:

a single trank having front and back sections;

the front section having, respectively an opening for a thumb front sections for an index finger, a middle finger, a ring finger, and a little finger, and back sections for the little finger and the ring finger;

the front section and back section for the little finger being continuous and folded along a first center line between the front section and back section for the little finger;

the back section having, respectively, back sections for the index finger and the middle finger, the back section for the index finger being provided with a groove that runs the length of the section for the index finger;

the front and back sections of the trank being continuous and folded along a second center line between the back section for the index finger and the front section for the index finger; and a thumb section integral to the trank at the opening, the thumb section having a front section and a back section, the front section and back section of the thumb section being continuous and folded along a third center line between the front section and the back section of the thumb section, the back section of the thumb section being provided with a groove that runs along the length of the thumb section;

each groove being covered and sewn from the inside of the glove with a flexible material.

4. The golf glove according to claim 3, wherein the flexible material is spandex.

* * * * *